US005110142A

United States Patent [19]

Szott

[11] Patent Number: 5,110,142

[45] Date of Patent: May 5, 1992

[54] VALVE STEM OIL SEAL

[75] Inventor: Michael J. Szott, Bartlett, Ill.

[73] Assignee: Macrotech Fluid Sealing, Inc., Salt Lake City, Utah

[21] Appl. No.: 619,916

[22] Filed: Nov. 30, 1990

[51] Int. Cl.[5] ..... F16J 15/32; F01L 3/08

[52] U.S. Cl. ..... 277/33; 123/188.6; 277/48; 277/152; 277/174; 277/181; 277/189

[58] Field of Search ..... 277/33, 35-37, 277/47, 48, 49, 50, 52, 152, 174, 181, 186, 189, 212 C; 123/188 P

[56] References Cited

U.S. PATENT DOCUMENTS

| | | | |
|---|---|---|---|
| 3,306,621 | 2/1967 | Fisher | 123/188 P X |
| 3,442,517 | 5/1969 | Skinner, Sr. | 123/188 P X |
| 3,477,730 | 11/1969 | Szcupak et al. | 277/52 X |
| 3,599,992 | 8/1971 | Kammerad | 123/188 P X |
| 3,771,799 | 11/1973 | Sekulich et al. | 277/47 X |
| 3,829,105 | 8/1974 | Kammerand | 123/188 P X |
| 3,910,586 | 10/1975 | Todaro | 123/188 P X |
| 4,055,352 | 10/1977 | Allinquant et al. | 277/152 |
| 4,124,220 | 11/1978 | Leone et al. | 123/188 P X |
| 4,425,838 | 1/1984 | Pippert | 277/152 X |
| 4,542,811 | 9/1985 | Miura | 277/152 X |
| 4,811,703 | 3/1989 | Rericha et al. | 123/188 P |
| 4,811,704 | 3/1989 | Boehmer et al. | 123/188 P |
| 4,811,960 | 3/1989 | Stritzke et al. | 123/188 P X |
| 4,822,061 | 4/1989 | Kammeraad | 123/188 P X |
| 4,928,644 | 5/1990 | Travis | 123/188 P |
| 4,947,811 | 8/1990 | Binford | 123/188 P |

FOREIGN PATENT DOCUMENTS

| | | | |
|---|---|---|---|
| 2312135 | 9/1974 | Fed. Rep. of Germany | 277/174 |
| 2137289 | 10/1984 | United Kingdom | 277/152 |

*Primary Examiner*—William A. Cuchlinski, Jr.
*Assistant Examiner*—Scott W. Cummings
*Attorney, Agent, or Firm*—Lyon & Delevie

[57] ABSTRACT

A valve stem oil seal comprises a cup-shaped case engageable with the valve guide of a piston-type internal combustion engine in sealing relationship. A seal element has a radial flange portion disposed between a radial flange on the case and a support washer so as to be radially movable relative thereto and an annular portion sealably engaged with the valve stem.

1 Claim, 1 Drawing Sheet

VALVE STEM OIL SEAL

BACKGROUND OF THE INVENTION

Valve stem oil seals are often positively mounted on the valve guide. Such a seal is taught in U.S. Pat. No. 4,811,960 entitled "Fixed Valve Stem Oil Deflector" and assigned to the assignee hereof. Such oil seals completely seal the environmental conditions within the valve chamber of the engine from the intake and exhaust system of the engine.

However, a problem has arisen in that positive mounting of known valve stem oil seals does not effectively accommodate misalignment and/or articulation between the central axis of the valve stem and the central axis of the valve guide due to manufacturing tolerance error or operating conditions.

SUMMARY OF THE INVENTION

The instant invention relates to a valve stem oil seal that is mounted on the valve guide of an internal combustion engine so as to positively seal the valve stem and valve guide from the environment of the valve chamber yet accommodate misalignment and articulation of the valve relative to the valve guide. The oil seal comprises a cup-shaped case that supports an annular one piece laterally movable fluoroelastomer seal element. The seal element has a radially inwardly facing sealing surface that engages the valve stem and a pair of opposite axially facing sealing surfaces on a radial flange that engage complementary axially facing surfaces on the cup-shaped case and on a support washer. The cup-shaped case supports a "square-ring" that effects both retention and sealing of the case to the valve guide. The case comprises three elements that are ultrasonically welded to one another in nesting relationship with the seal element in position therebetween. The nested relationship of the case elements maintains a constant gap between radial flanges thereon, which allows the seal element to move radially therebetween and defines a gap for acceptance of the "square-ring".

DETAILED DESCRIPTION OF THE PREFERRED EMBODIMENT OF THE INVENTION

Figure 1:
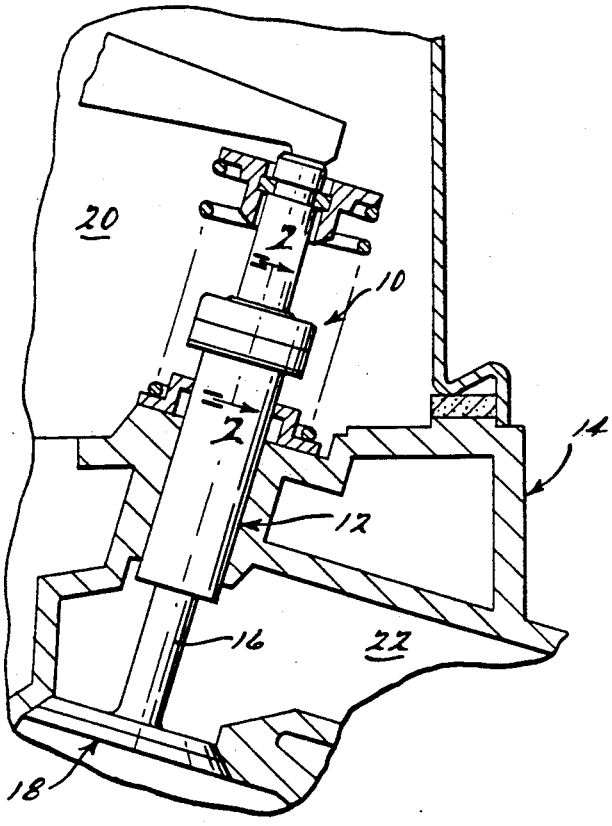
FIG. 1 is a fragmentary view, partially in section, of a valve stem oil seal in accordance with the present invention in its operating environment.

As seen in FIG. 1, a valve stem oil seal 10, in accordance with a preferred constructed embodiment of the present invention, is mounted on a valve guide 12 of an internal combustion engine 14 so as to positively seal a valve stem 16 of a valve 18 relative to the valve guide 12. The oil seal 10 seals the environment of a valve chamber 20 from that of a manifold 22 yet accommodates misalignment of the central axis of the valve 18 and valve guide 12.

Figure 2:
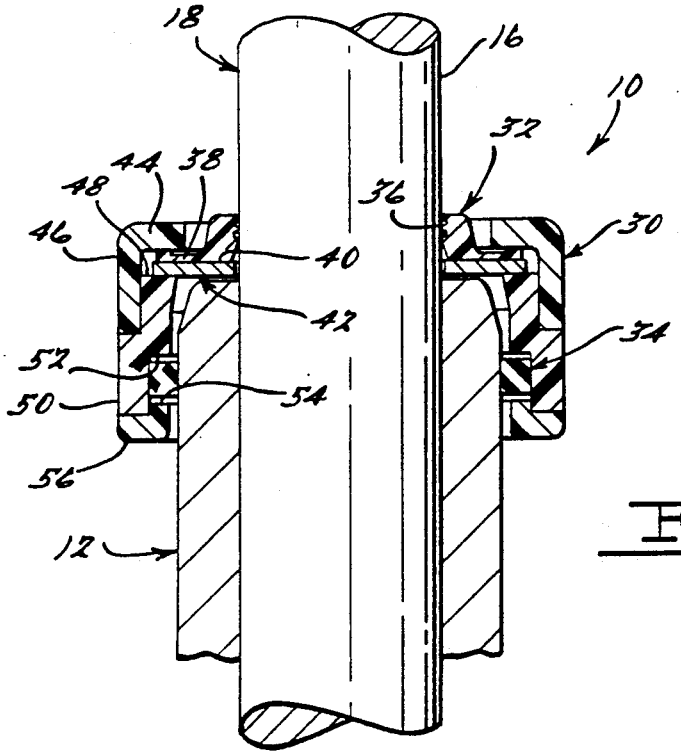
FIG. 2 is a cross-sectional view taken along the line 2—2 of FIG. 1.

As seen in FIGS. 2, the oil seal 10 comprises a three piece cup-shaped case 30 that supports a laterally movable fluoroelastomer seal element 32 and a polyacrylate square ring 34. The seal element 32 has a plurality of radially inwardly facing sealing rings 36 thereon that engage the valve stem 16. The seal element 32 also has a radially extending flange 38 that is engaged between a seating surface 40 on a brass washed 42 and a radial flange 44 of an upper element 46 of the cup-shaped case 30. A radially inwardly extending surface 48 on an intermediate portion 50 of the case 30 serves as a support surface for the washer 42. The square ring 34 is trapped between radial flanges 52 and 54 on the element 50 and a lower case element 56, respectively.

A seal is effected by the radially extending flange 38 of the seal element 32 against the flange 44 on the case element 46 of the case 30 and upper surface of the washer 42. The seal 32 is free to shift radially to self center itself on the vale stem 16 upon installation and during operation of the engine 14. The cup-shaped case 30 is sealably retained in position on the valve guide 12 by the square ring 34.

From the foregoing description, it should be apparent that the three elements 46, 50 and 56 of the case 30, when assembled, provide the necessary sealing and support surfaces for the seal element 32 and square ring 34.

While the preferred embodiment of the invention has been disclosed, it should be appreciated that the invention is susceptible of modification without departing from the scope of the following claims.

I claim:

1. A fixed valve stem oil seal comprising:

a three-piece cup-shaped case having a central longitudinal axis and defined by three longitudinally spaced outer wall portions telescoped within one another;

an upper portion of said case comprising a generally cylindrical portion having a radially inwardly extending flange with a central aperture for the acceptance of a valve stem;

a generally cylindrical intermediate portion of said case nested with the upper portion thereof and having a first radially extending surface disposed radially inwardly of the cylindrical portion of said upper case portion in axially spaced relation to the radial flange on said upper case portion, a second radially outwardly extending surface axially spaced from said first surface and engageable with a complementary lower end face of said upper case portion, a third radially inwardly extending surface defining an upper surface of an "O" ring groove, and an annular lower end face;

a seal support washer seated on the first radial surface of the intermediate portion of said case and having a central aperture for the acceptance of the valve stem;

a seal element having a radially extending portion disposed between the radial flange on the upper case portion and said seal support washer and radially movable relative thereto, said seal element having an annular sealing surface engageable with the valve stem;

a generally cylindrical lower case portion nested with said intermediate case portion and having a first radially outwardly extending surface engageable with the lower end face of said intermediate case portion, a second radially inwardly extending surface defining a lower wall portion of said "O" ring groove, and a third axially extending surface defining a longitudinal wall of said "O" ring groove; and an annular elastomeric "O" ring disposed between the third radial surface on said intermediate case portion and the second radial surface on said lower case portion for retaining said valve stem oil seal on a valve guide, whereby said upper, intermediate, and lower case portions are assembled with one another solely by relative longitudinal movement.

* * * * *